US011472198B2

(12) United States Patent
Llorach To et al.

(10) Patent No.: US 11,472,198 B2
(45) Date of Patent: Oct. 18, 2022

(54) ROLLERS FOR DRYER SYSTEM

(71) Applicant: HEWLETT-PACKARD DEVELOPMENT COMPANY, L.P., Spring, TX (US)

(72) Inventors: Marcel Llorach To, Sant Cugat del Valles (ES); Benito Ruiz Arnega, Sant Cugat del Valles (ES); Eduardo Martin Orue, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/978,041

(22) PCT Filed: Apr. 30, 2018

(86) PCT No.: PCT/US2018/030226

§ 371 (c)(1),
(2) Date: Sep. 3, 2020

(87) PCT Pub. No.: WO2019/212491

PCT Pub. Date: Nov. 7, 2019

(65) Prior Publication Data

US 2021/0039382 A1 Feb. 11, 2021

(51) Int. Cl.

| | |
|---|---|
| ***B41J 11/00*** | (2006.01) |
| ***B41F 23/04*** | (2006.01) |
| ***B41J 15/16*** | (2006.01) |

(52) U.S. Cl.

CPC ..... *B41J 11/002* (2013.01); *B41F 23/0403* (2013.01); *B41J 11/0021* (2021.01); *B41J 11/0022* (2021.01); *B41J 11/0024* (2021.01); *B41J 15/16* (2013.01)

(58) Field of Classification Search

CPC ..... B41F 23/0403; B41J 11/002; B41J 15/16; B41J 11/02; B41J 11/021; B41J 11/022; B41J 11/024

See application file for complete search history.

(56) References Cited

U.S. PATENT DOCUMENTS 4,627,607 A * 12/1986 Ishii ..... B65H 3/5261 271/122
5,351,945 A * 10/1994 Asakawa ..... B65H 3/5261 271/118
6,078,345 A * 6/2000 Yamakawa ..... B41J 11/005 347/218

(Continued)

*Primary Examiner* — David H Banh
(74) *Attorney, Agent, or Firm* — HP Inc. Patent Department

(57) ABSTRACT

In an example, a dryer system may include a dryer, a plurality of passive rollers, and a tension engine to maintain tension on web media based on dryer pressure. In another example, a dryer system includes a plurality of passive rollers in a drying zone and a moveable platen having a surface defining apertures corresponding to the plurality of rows of passive rollers such that the surface of the platen moves relative to an axis of the roifers. In another example, a platen device includes a roller, a moveable platen having a surface defining an aperture through which the roller fits, and a cover that moves in conjunction with movement of the platen to cover the aperture when the surface of the platen is adjusted to a height above the axis of the roller.

14 Claims, 6 Drawing Sheets

(56) References Cited

U.S. PATENT DOCUMENTS

| | | | | |
|---|---|---|---|---|
| 6,354,015 | B1 | 3/2002 | Ogasawara et al. | |
| 6,666,536 | B2 | 12/2003 | Nakanishi et al. | |
| 7,431,278 | B2 * | 10/2008 | Hiraki | B41J 11/0085 271/266 |
| 8,684,510 | B2 | 4/2014 | Miyamoto et al. | |
| 9,381,755 | B2 | 7/2016 | Maza et al. | |
| 2002/0030706 | A1 * | 3/2002 | Nakanishi | B41J 11/20 347/8 |
| 2002/0180828 | A1 | 12/2002 | Webster | |
| 2003/0156873 | A1 * | 8/2003 | Nebashi | B41J 11/20 400/58 |
| 2004/0234314 | A1 * | 11/2004 | Tozaki | B41J 11/0095 400/120.01 |
| 2004/0239742 | A1 * | 12/2004 | Hiraki | B41J 11/0085 347/104 |
| 2005/0104278 | A1 * | 5/2005 | Lin | B65H 3/565 271/121 |
| 2005/0281582 | A1 * | 12/2005 | Mercer | G03G 21/1832 399/114 |
| 2006/0250473 | A1 * | 11/2006 | Ishii | B41J 11/0065 347/104 |
| 2009/0179962 | A1 | 7/2009 | Karppinen | |
| 2011/0025758 | A1 | 2/2011 | Rosati | |
| 2012/0223476 | A1 * | 9/2012 | Nakayama | B65H 3/5207 271/274 |
| 2013/0135415 | A1 | 5/2013 | Claramunt | |
| 2015/0239690 | A1 * | 8/2015 | Muir | B65H 29/245 271/3.19 |
| 2017/0266998 | A1 * | 9/2017 | Miyashita | B41J 11/663 |

* cited by examiner

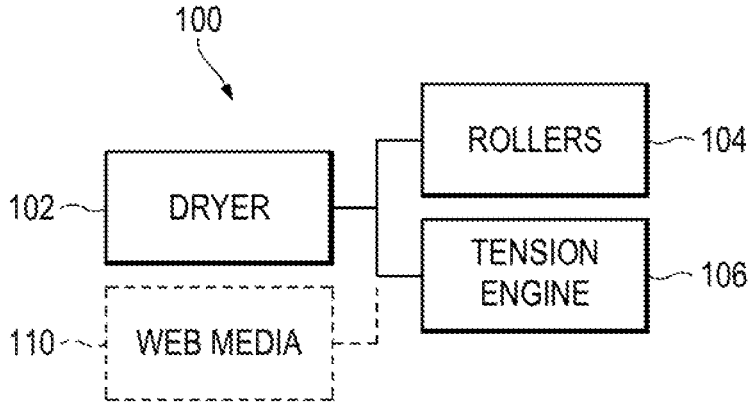
FIG. 1
FIG. 2
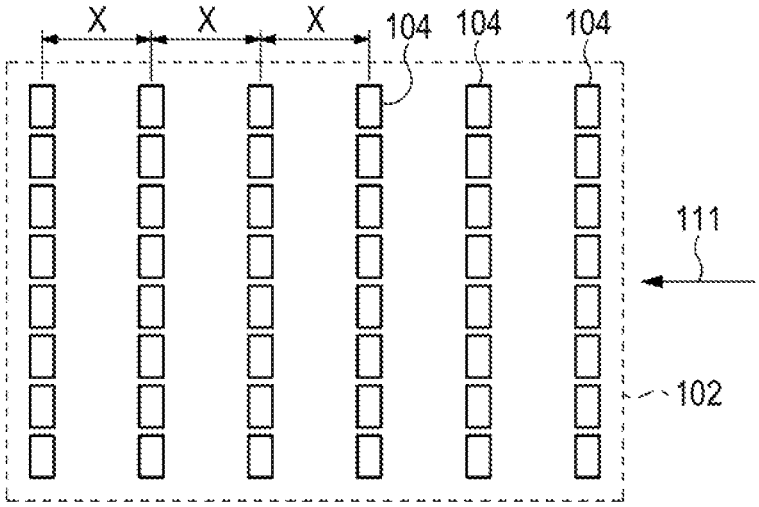
FIG. 3
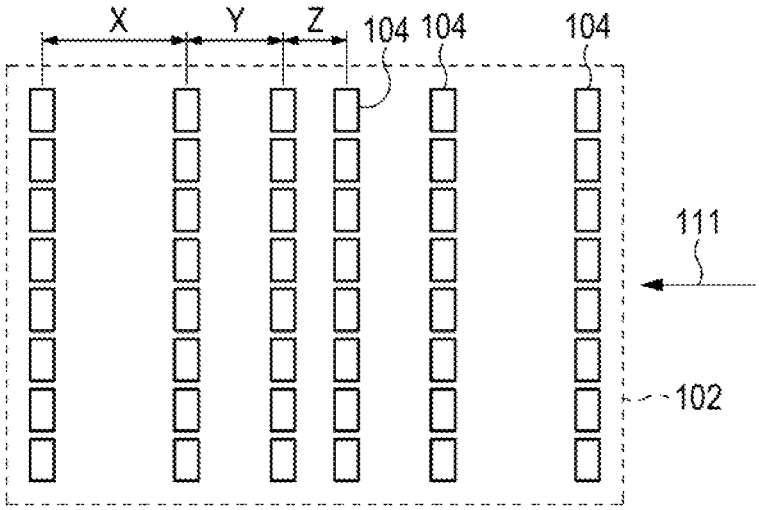

ROLLERS FOR DRYER SYSTEM

BACKGROUND

A print apparatus may use media to produce an image. A print apparatus may include a media path to move media to various zones of the print apparatus between input to output. A print apparatus may deposit print material that utilizes a post-printing process, such as drying, depending on the print material and/or print medium being used.

BRIEF DESCRIPTION OF THE DRAWINGS

FIG. 1 is a block diagram depicting an example dryer system.

FIGS. 2 and 3 depict example organizations of example rollers of an example dryer system.

DETAILED DESCRIPTION

Figure 5:
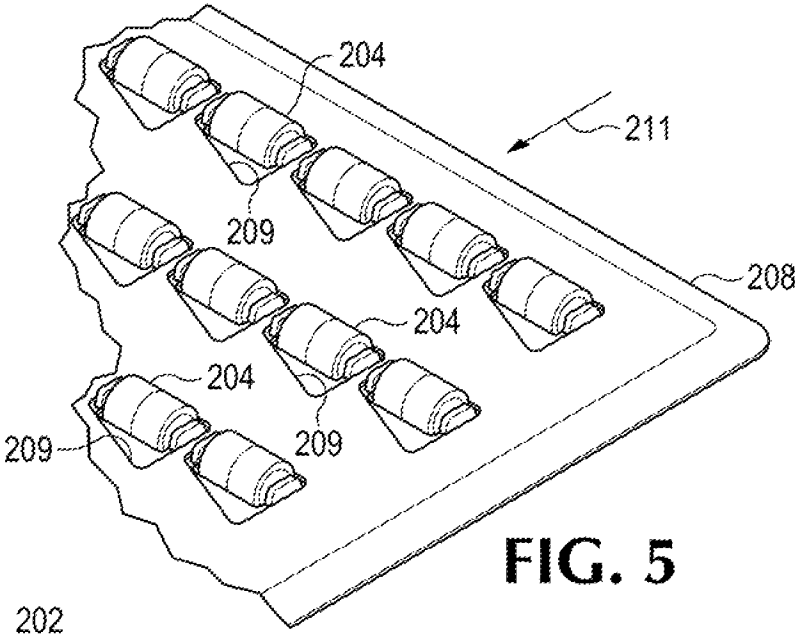
FIG. 5 is an isometric view of an example moveable platen and example rollers.

In the following description and figures, some example implementations of print apparatus, dryer systems, media handling systems, and/or platen devices. In examples described herein, a "print apparatus" may be a device to print content on a physical medium (e.g., paper, textiles, a layer of powder-based build material, etc.) with a print material (e.g., ink or toner). For example, the print apparatus may be a wide-format print apparatus that prints pigment-based print fluid on a print medium, such as a print medium that is size A2 or larger. In some examples, the physical medium printed on may be a web roll or a pre-cut sheet. In the case of printing on a layer of powder-based build material, the print apparatus may utilize the deposition of print materials in a layer-wise additive manufacturing process. A print apparatus may utilize suitable print consumables, such as ink, toner, fluids or powders, or other raw materials for printing. In some examples, a print apparatus may be a three-dimensional (3D) print apparatus. An example of fluid print material is a water-based latex ink ejectable from a print head, such as a piezoelectric print head or a thermal inkjet print head. Other examples of print fluid may include dye-based color inks, pigment-based inks, solvents, gloss enhancers, fixer agents, and the like.

Dryers may be added to a print apparatus to accelerate the drying process. A dryer may generate a drying temperature to remove an amount of water from the print medium over a period of time in a drying zone. In such an example, a length of the drying zone may be based on the speed of the media through the drying zone. Dryers as used herein may also include systems that perform curing of print material, such as latex-based ink, or fusing of print material, such as build material, e.g., latex-based powders.

Marks may be generated on the print medium based on non-uniform contact of the print medium with a media support surface in the drying zone. For example, a ribbed platen may generate marks where the ribs of the platen contact the print medium during the drying process. This may occur due to heat absorption of the platen structure or other effects on the drying environment from the platen structure with respect to the print medium, for example. Example systems that may produce non-uniform contact include vacuum belts or friction platens that may transfer heat of the print medium to the belt or platen in varying amounts based on the non-uniform contact across the print medium (such as if there is a wrinkle on the media or the holes of the belt). In such an example, a visible difference in color may appear.

Various examples described below relate to reducing marks generated during the drying process of a print job. By exchanging the print medium support from a platen to being supported by rollers, the amount of contact with the print medium may be reduced and drying marks on the final output image may be reduced accordingly, for example.

FIG. 1 is a block diagram depicting an example dryer system 100. Referring to FIG. 1, the example dryer system 100 generally includes a dryer 102, a plurality of rollers 104, and a tension engine 106. In general, the tension engine 106 maintains an amount of tension of web media 110 across rollers 104 corresponding to a drying zone where the dryer 102 applies a drying operation on the web media 110. In example operation, the dryer 102 provides a heated flow of air over the printed media surface to thereby, for example, ensure adequate drying occurs after ejecting print material on to the web media 110 in a printing zone of a print apparatus and prior to the web media 110 being wound upon the take-up spool. In an example, the dryer 102 provides a substantially constant flow of air.

The dryer 102 may be any appropriate dryer useable to perform a drying operation on media 110 compatible with a print apparatus. Example dryers include heaters, impinging dryers, convection dryers, radiation dryers, forced air dryers, ultraviolet (UV) dryers, and the like, or any combination thereof. The dryer 102 may directly alter the media 110 or may indirectly alter the media 110 by modifying a characteristic of the environment in the drying zone. For example, a heater may warm the ambient environment of the drying zone and a forced air dryer may direct hot air towards media. The dryer 102 may be used to evaporate solvent fluid (for example, water, glycol or the like) from a print material. When the dryer lengths are greater than a threshold (e.g., more than 250 mm) and a ribbed platen is used, the friction with the ribs may cause a downwards deformation of the media between ribs, where such deformations (e.g., the catenary effect) may be greater for such dryer lengths in comparison for a length that may be less in other dryer systems (e.g., less than 250 mm) when the tension in each system is maintained the same. The dryer 102 may include a controller to control the pressure of the dryer 102 based on the media and/or the tension maintained by the tensions engine 106.

The dryer 102 may be placed to dry web media 110 in a drying zone of a print apparatus between a printing zone and a media output holder. The media output holder may be any media output device such as a spool, a tray, an output accessory, or any other post-printing device. The dryer 102 may be located relatively close to the media support of the media path corresponding to the drying zone. For example, the dryer 102 may be located between about 3-6 mm above the media support structure (e.g., the rollers 104 or a platen) in the drying zone. The dryer 102 may be located relatively close to the web media, such as within 4 mm.

The plurality of rollers 104 are used to reduce contact with support while the web media 110 is in the drying zone, e.g., when compared to ribbed platens. For example, the plurality of passive rollers 104 are located in a media path of the drying zone and spaced apart in the media advance direction a distance corresponding to a deformation threshold (e.g., less than a deformation threshold) based on expected pressure from the dryer 102 on the web media 110 and greater than a number of contact points with reference to a quality assurance threshold. The rollers 104 may include any appropriate cylindrical or spherically shaped supports capable of rotation. For example, the rollers 104 may be starwheels, casters, bearings, or the like.

The plurality of rollers 104 may be organized into rows, with the rows of rollers being spaced apart a distance based on potential deformation of the web media 110 while in the drying zone. A deformation threshold, as used herein, represents a displacement of the media in the direction of pressure from the dryer. For example, the distance between rollers may be organized close enough together to not let the media droop down beyond the deformation threshold but far enough apart to reduce the amount of contact of the media with roller surfaces. In this manner, the distance between rollers may be selected based on the potential from the pressure of the dryer to deform the web media (e.g., a high-pressure dryer may have rollers closer together than a low-pressure dryer). For example, the rollers may be spaced about 300 mm apart to ensure a maximum deformation displacement at that location is less than 3.8 mm based on 10 Pa of pressure from the dryer. In another example using the same amount of tension, the rollers may be spaced about 150 mm apart to ensure a maximum deformation displacement at that location is less than 3.8 mm based on 20 Pa of pressure from the dryer. In those examples, the implementation of distance between the dryers may be based on the expected pressure from the dryer.

The passive rollers may be organized into rows widthwise across a media path. For example, the passive rollers 104 may be organized into rows oriented along a width of the media path with the passive rollers 104 of each row aligned along a rotation axis of the passive rollers 104 and the rows are spaced apart a distance that may be determined based on a deflection expected from pressure from the dryer 102. For another example, an array of rollers 104 disposed in a series of lines perpendicular to the media advance direction 111 are shown in FIG. 2. FIGS. 2 and 3 depict example organizations of example rollers 104 of an example dryer system. The rows of rollers 104 are equally spaced apart in FIG. 2 and are spaced apart at different intervals in FIG. 3. The rows may be located in the drying zone and the separation distance between the rows may be defined based on different pressure amounts expected across the drying zone. For example, the rows of passive rollers may be spaced apart at distances that are smaller towards a center of the dryer. For another example, the rows of passive rollers may be spaced apart at distances that are smaller closer to where there are higher amounts of pressure expressed from the dryer 102 and spaced apart at distances greater where there are lower amounts of pressure expressed from the dryer 102. For yet another example, the rows may be spaced closer together where greater pressure is expected from the dryer. In this manner, the rows of rollers may be spaced apart at venous distances with respect to various pressures across the dryer 102. FIG. 3 is an example where the rows of passive rollers are spaced apart at distances that vary based on differing amounts of pressure expelled across the length of the dryer with respect to the media advance direction, such as when the dryer expels a higher amount of pressure across a middle section and lesser amounts of pressure towards the edges of the media path.

The media, under the pressure generated by the dryer, may take a catenary-like shape, which may have a deformation that depends on the pressure from the dryer (e.g., the pressure of air expelled by the dryer), the thickness and Young's modulus of the paper, the distance between the roller lines, and the tension of the media. For example, the dryer system 100 includes circuitry capable of determining the dryer pressure and/or tension and, in response to the status of the dryer pressure and/or tension, operating the dryer 102 and/or tension engine 106 to ensure that a deformation threshold is not exceeded.

The tension engine 106 represents any circuitry or combination of circuitry and executable instructions to maintain an amount of tension on the web media 110. For example, the tension engine 106 may be a combination of circuitry and executable instructions to operate a media input holder and a media output holder to maintain an amount of tension on the web media in the drying zone based on dryer pressure, a distance between rollers, and a characteristic of the roll of web media. The tension engine 106 may include a controller to control the tension based on the media and/or the pressure. The web media 110 may be any appropriate type of media usable with a print apparatus. The tension engine 106 may maintain tension on the web media 110 based on a characteristic of the media 110. For example, the flexibility of the web media 110 may have an effect on the amount of deflection experienced in the drying zone. An amount of deflection from pressure from the dryer 102 may be identified according to the following formula:

$$v(x) = C_1 e^{X\sqrt{\frac{T}{EI}}} + C_2 e^{-X\sqrt{\frac{T}{EI}}} - \frac{qx^2}{2T} + \frac{qdx}{2T} - M_1$$

where:

$$C_1 = \frac{qd}{2T}\sqrt{\frac{EI}{T}}\left(\frac{e^{-d\sqrt{\frac{T}{EI}}}}{1 - e^{-d\sqrt{\frac{T}{EI}}}}\right),$$

$$C_2 = \frac{qd}{2T}\sqrt{\frac{EI}{T}}\left(\frac{1}{1 - e^{-d\sqrt{\frac{T}{EI}}}}\right),$$

$$M_1 = \frac{qd}{2T}\sqrt{\frac{EI}{T}}\left(\frac{e^{-2d\sqrt{\frac{T}{EI}}}}{\left(1 - e^{-d\sqrt{\frac{T}{EI}}}\right)^2}\right),$$

v(x) [mm] is the deflection perpendicular to the surface suffered by the media, q [N/mm$^2$] is the force against the media surface due to air pressure and the gravitational force due to media weight, T [N/mm] is the tension applied to the media in the media advance direction, E [N/mm$^2$] is the Young's Modulus of the media, l [mm$^3$] is the inertia of the media in the rollers axis direction (e.g., perpendicular to the media advance direction) per unit of width, and d [mm] is the distance between roller lines.

The relation between the tension and the distance between the array of rollers is maintained by the tension engine 106 such that the deflection of the media does not affect the drying efficiency (e.g., does not allow the media to make contact with an object between rollers in the drying zone, such as the area of a platen between rollers). For example, the rollers may be spaced about 300 mm apart, the pressure from the dryer may be 10 Pa, and a deformation displacement of 3.8 mm may be maintained using about 20 N per meter of tension. For another example, where if the distance between rollers is 150 mm, 20 N per meter of tension may generate a displacement of 0.5 mm.

The heat is transferred from the dryer 102 to the print material (e.g., ink) and media. By having the media "floating" with minimum contact, heat losses due to conduction are minimized, for example. The losses due to natural convection with the air under the media are several orders of magnitude smaller than the heat transferred by the dryer, and therefore have relatively low impact, for instance. Minimalizing the amount of heat losses also helps in avoiding drying marks, for example The tension engine 106 may comprise a memory resource operatively coupled to a processor resource. For example, the tensions engine 106 may include a controller comprising a processor resource and a memory resource having a control program stored thereon, that when executed by the processor resource causes the processor resource to perform operations of the control program, such as to cause an amount of tension to be maintain on the media. A memory resource may contain a set of instructions that are executable by the processor resource and the set of instructions are operable to cause the processor resource to perform operations of the tension engine 106 when the set of instructions are executed by the processor resource.

A processor resource is any appropriate circuitry capable of processing (e.g., computing) instructions, such as one or multiple processing elements capable of retrieving instructions from a memory resource and executing those instructions. For example, the processor resource may be a central processing unit (CPU) that enables maintaining tension by fetching, decoding, and executing modules of instructions. Example processor resources include at least one CPU, a semiconductor-based microprocessor, a programmable logic device such as an application specific integrated circuit (ASIC), and the like. A processor resource may include multiple processing elements that are integrated in a single device or distributed across devices. A processor resource may process the instructions serially, concurrently, or in partial concurrence.

A memory resource represents a medium to store data utilized and/or produced by the tension engine 106. The medium is any non-transitory medium or combination of non-transitory media able to electronically store data, such as modules of the tension engine 106 and/or data used by the tension engine 106. For example, the medium may be a storage medium, which is distinct from a transitory transmission medium, such as a signal. The medium may be machine-readable, such as computer-readable. The medium may be an electronic, magnetic, optical, or other physical storage device that is capable of containing (i.e., storing) executable instructions. A memory resource may be integrated in the same device as a processor resource or it may be separate but accessible to that device and the processor resource. A memory resource may be distributed across devices. A memory resource may be a non-volatile memory resource such as read-only memory (ROM), a volatile memory resource such as random-access memory (RAM), a storage device, or a combination thereof.

Figure 4:
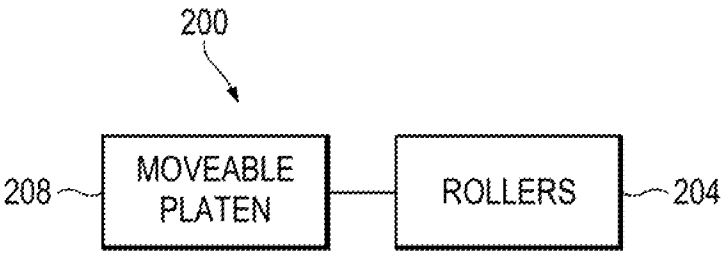
FIG. 4 is a block diagram depicting an example media handling system.

FIG. 4 is a block diagram depicting an example media handling system 200. Referring to FIG. 4, the media handling system 200 generally includes a moveable platen 208 and a plurality of rollers 204. The plurality of rollers 204 may be organized into rows as described herein with respect to FIGS. 1-3. For example, a plurality of rows of passive rollers may be located in a media path of a drying zone where each row is oriented across a width of the media path to support a print medium and spaced apart a distance greater than a diameter of the passive rollers.

The moveable platen 202 includes a surface to support the print medium that is capable of changing positions. For example, a moveable platen 208 may be a substantially flat, planar surface on which a print medium may rest and the substantially flat, planar surface may change height with respect to the position of a dryer (e.g., the dryer 202 of FIG. 6). The moveable platen 208 may have a surface defining apertures corresponding to the plurality of rows of passive rollers 204 such that the surface of the platen 208 moves independent of rollers 204 while the rollers 204 may interface with the platen 208 (e.g., the platen moves relative to the axis of the rollers to be at a different height than the rollers in various states of print apparatus operation).

Figure 6:
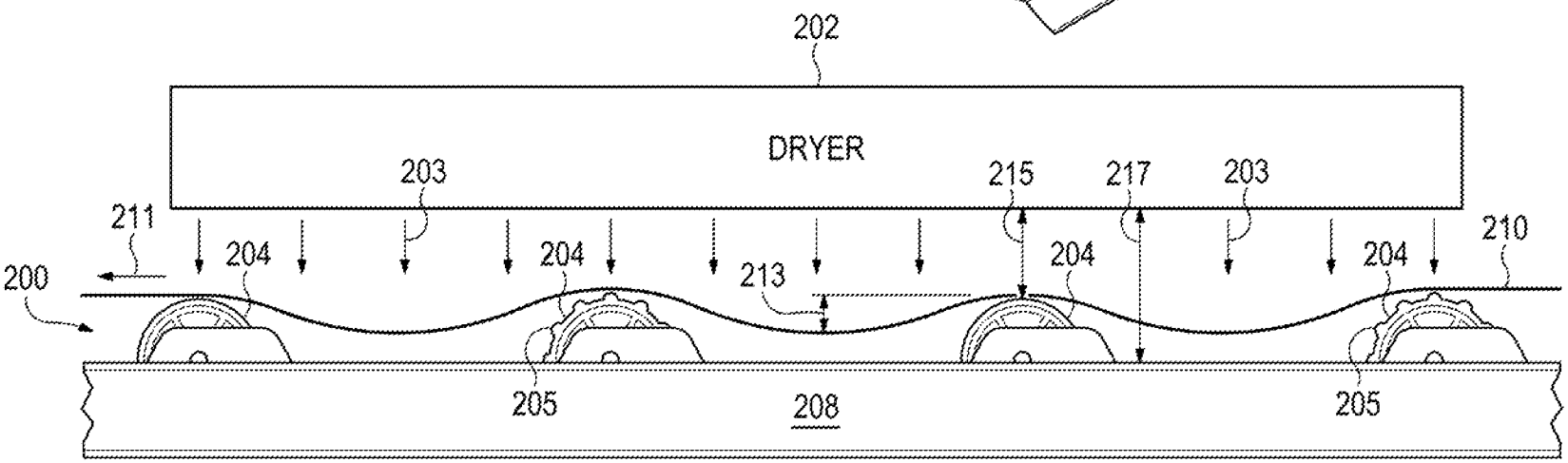
FIGS. 6-8 depict example environments in which various dryer systems may be implemented.

The moveable platen 208 may move relative to the plurality of passive rollers 204 and a dryer (e.g., such as dryer 202 of FIG. 6). For example, the moveable platen 208 may be placed in a raised position towards the dryer above an outer surface of the passive rollers 204 when the print apparatus is in a loading state to receive the web media into the drying zone and the moveable platen may be placed in a recessed position away from the dryer below the outer surface of the passive rollers when the print apparatus is in a non-loading state to pass media through the drying zone. For another example, the rollers 204 may be attached to a fixed support and the platen 208 may include a surface with holes (into which fit the rollers 204) such that the platen 208 can be controllably moved by a motor to change height with respect to the axis of the rollers 204. The moveable platen 208 may be coupled to a guide structure and a motor that controls a height of the moveable platen 208 along a direction defined by the guide structure.

FIG. 5 is an isometric view of an example moveable platen 208 and example rollers 204. A surface of the moveable platen 208 may define apertures 209 relative to positions of the rollers 204. In this manner, the rollers 204 may be useable to support media when the rollers 204 protrude from the apertures in the platen 208. The apertures 209 may be defined by edges making a shape large enough to accommodate a roller 204 or multiple rollers 204. For example, the apertures 209 may substantially be the shape of a cross-section of a roller 204. In the example of FIG. 5, the surface of the moveable platen 208 includes a sloping edge and, at the area of the apertures 209, includes an oblique plane (e.g., defined by an edge cut oblique to the media advance direction) following the apertures 209 with respect to the media advance direction. The oblique plane may be oblique with respect to the vertical direction and/or horizontal directional. An aperture 209 having an oblique edge may deter print media from crashing into the aperture 209 and may guide the print media over the aperture 209 by removing surface support for the media in a gradual manner with respect to the media advance direction.

Figure 7:
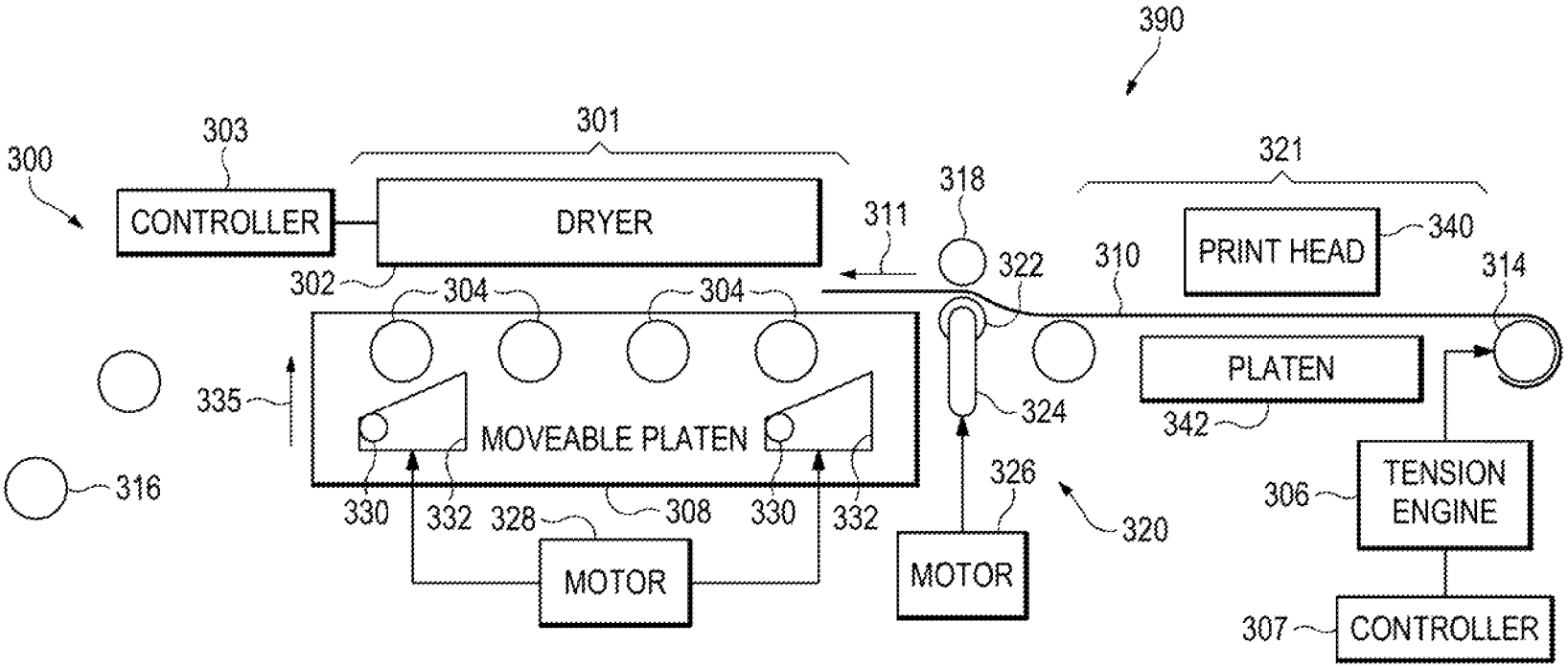
Figure 8:
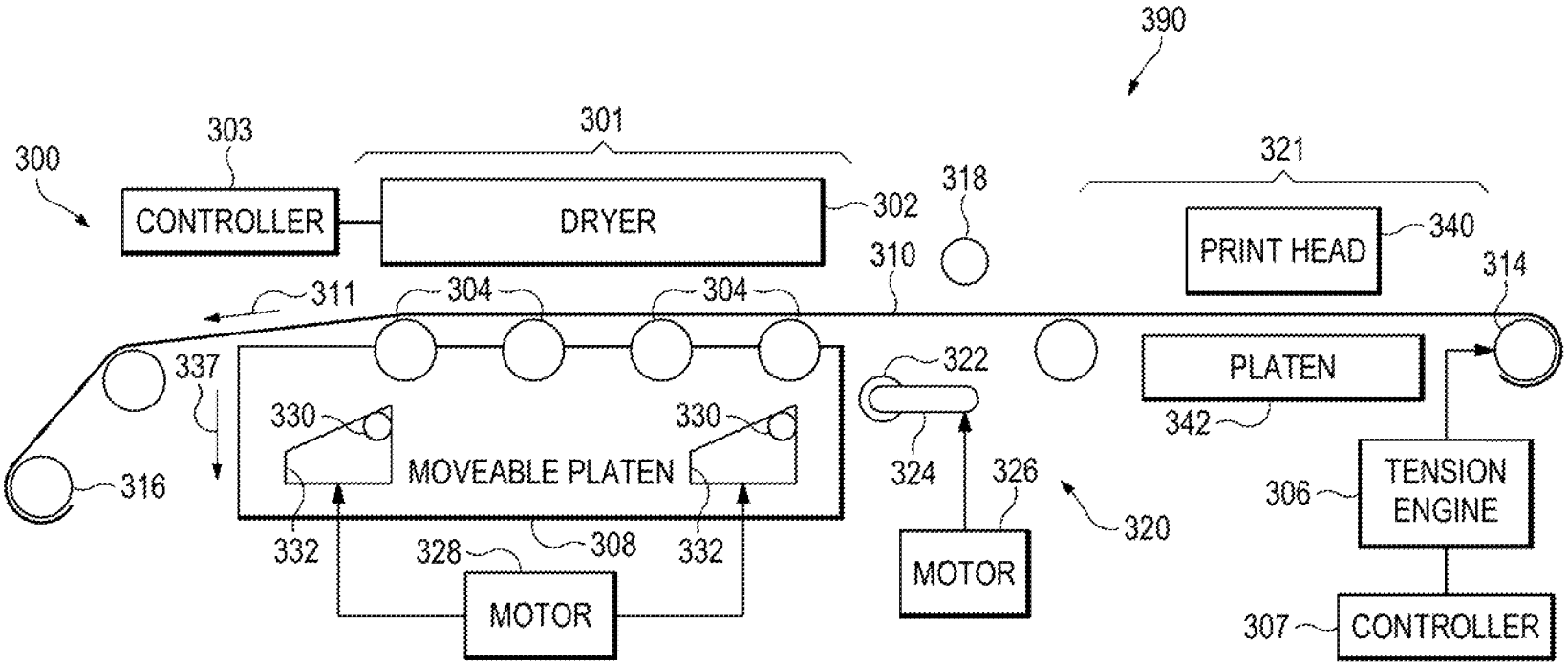

FIGS. 6-8 depicts example environments in which various dryer systems 300 and/or media handling systems 200 may be implemented. Referring to FIG. 6, the example dryer system may generally include a dryer 202 and a media handling system 200 including a moveable platen 208 and a plurality of rollers 204. The moveable platen 208 and the plurality of rollers 204 are located in the direction of the drying operation performed by the dryer 202 (e.g., located below the dryer 202). The media 210 may pass through the drying zone between the dryer 202 and the rollers 204 and/or platen 208. The dryer 202 may be perform a drying operation and generate pressure 203 on the print media 210 while in the drying zone. The pressure 203 may be generally perpendicular to the media advance direction 211. The pressure 203 may exert force on the print media 210 which may result in a deformation 213 at areas of the print media 210 unsupported by the rollers 204.

The passive rollers 204 may include a plurality of formations 205 on an outer surface of the passive roller 204. The formations 205 may further reduce the amount of contact with the print media 210 while in the drying zone. For example, rollers with knurled skin may reduce the heat transfer from the print media to the rollers 204 where such heat may induce drying marks on the media. The material attributes may also influence the heat transfer from the print media to the roller. For example, the rollers 204 may be made of a plastic material with relatively lower thermal conductivity than other plastics or metals to, for example, reduce the drying mark effect. In this manner, the rollers 204 may include an outer layer having a shape and/or material to further reduce contact and/or thermal conductivity between the print media 210 and the media supports in the drying zone.

The dryer 202 may be placed relatively close to the media supports corresponding to the drying zone to appropriately dry the media 210. For example, the rollers 204 may be located a distance 215 about 4 mm from the dryer 102. The distance 215 of the rollers to the dryer 202 may be fixed. The moveable platen 206 may change in distance 217 from the dryer 202. For example, in a non-loading state of operation, the moveable platen 206 may be 5-10 mm away from the dryer 102. For another example, the moveable platen 206 may be 3-5 mm away from the dryer 202 in a loading state to cover the rollers 204 at a distance 215 of about 5 mm from the dryer 202.

Referring to FIGS. 7 and 8, an example print apparatus 390 is depicted in an example loading state and an example non-loading state respectively. The print apparatus 390 of FIGS. 7 and 8 generally includes a print head 340, a print platen 342, a dryer 302, a moveable platen 308, a media input holder 314, a media output holder 316, and a tension engine 306. The media 310 passes in the direction 311 along a media path including a print zone 321 (e.g., where the print engine is located) and a drying zone 301 (e.g., where the dryer system 300 is located).

Referring to FIG. 7, the media 310 is being loaded into the print apparatus 300 and the moveable platen 308 is in a raised position towards the dryer 302 in the direction 335 while the rollers 304 are in a position to not be in contact with the web media 310 while in the drying zone 301. A pushing device 320 is located before the dryer 302 to move the web media 310 onto to the moveable platen 308 and into the drying zone 301. The pushing device 320 includes a support roller 318, a driven roller 322, an arm 324, and a motor 326. The driven roller 322 is coupled to the arm 324 and the motor 326 is coupled to the arm 324 and the driven roller 322. The motor 326 actuates to generate rotation of the roller 322 and the arm 324 concurrently such that the arm 324 rotates to place the driven roller 322 in a position to contact the web media 310 at the support roller 318 concurrent to the driven roller 322 providing force on the web media 310 in the media advance direction 311 using the support roller 318. The tension engine 306 maintains tension on the web media 310 appropriate to loading the media 310 into the drying zone 301 towards the media output holder 316. In this manner, driven rollers may be used outside of the drying zone 301 while passive rollers are located within the drying zone 301. The tension engine 306 may maintain tension to adapt to use with the pushing device. For example, the tension engine 306 may maintain some tension with respect to rotation of gears and/or the drive roller 322 to facilitate loading, where the leading edge of the media may have no tension as it passes the pushing device and enters the drying zone 301.

Referring to FIG. 8, the media 310 is passing through the drying zone 301 of the print apparatus 300 and the moveable platen 308 is in a non-loading position moved away from the dryer 302 in the direction 337. The pushing device 320 is in a non-operating state and the motor 326 has moved the arm 324 and 322 out of position to avoid contact with the media 310.

The motor 328 may control the height of the moveable platen by operating a cam mechanism. In FIG. 8, the moveable platen 308 has moved into a recessed position for non-loading operations using the cam mechanism including plates 332 and pins 330. The motor 328 may operate a set of gears to move the pins 330 with respect to the plates 332 as guided by the shape of an edge of the plate 332. For example, the plates 332 may move from left-to-right or right-to-left to force the pins 330 up or down, respectively, while the pins 330 are coupled to the moveable platen 308 such that the platen 208 moves with the movement of the pins 330. In other examples, the motor 328 may be coupled to a pin 330 to move the plate support 332 coupled to the platen such that the platen 308 moves with movement of the plate supports 332.

With the web media 310 connected to the media input holder 314 and the media output holder 316, the tension engine 306 is able to maintain tension with the media 310 by adjusting the holders 314 and 316, such as change the position or perform rotation. The tension engine 306 may include a controller 307 to control the tension based on the media type and/or the pressure expected from the dryer 302. The dryer 302 may include a controller 303 to control the pressure from the dryer 302 based on the media type and/or an amount of tension maintained by the tension engine 306. In this manner, the dryer 302 and the tension engine 306 may be used in conjunction with the other to maintain the media 310 within a deformation threshold based on the distance between rollers 304 in the drying zone 301.

Figure 9:
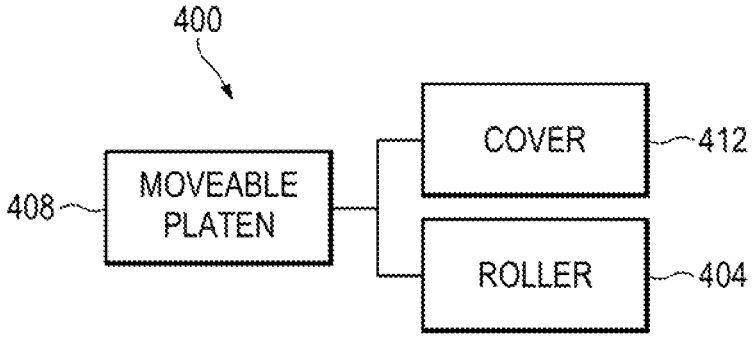
FIG. 9 is a block diagram depicting an example platen device.

FIG. 9 is a block diagram depicting an example platen device 400. Referring to FIG. 9, the platen device 400 generally includes a moveable platen 402, a cover 402, and a roller 404. The roller 404 is positioned to support media along a media path. The moveable platen 408 may include a surface defining an aperture through which the roller 404 fits. The moveable platen is able to adjust its height relative to the axis of rotation of the roller 404. The cover 402 includes a structure to cover the roller 404 and/or aperture of the moveable platen 408 when the moveable platen 408 is in a raised position for loading media. For example, the cover 402 moves in conjunction with movement of the moveable platen 408 to cover the aperture when the surface of the platen 408 is adjusted to a height above the axis of the roller 404.

Figure 10:
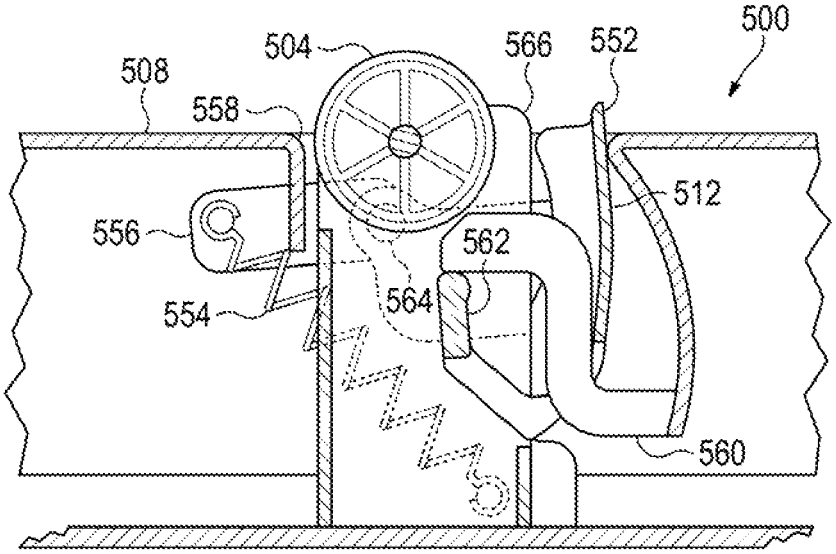
FIGS. 10-13 are sectional views depicting examples states of example platen devices.
Figure 11:
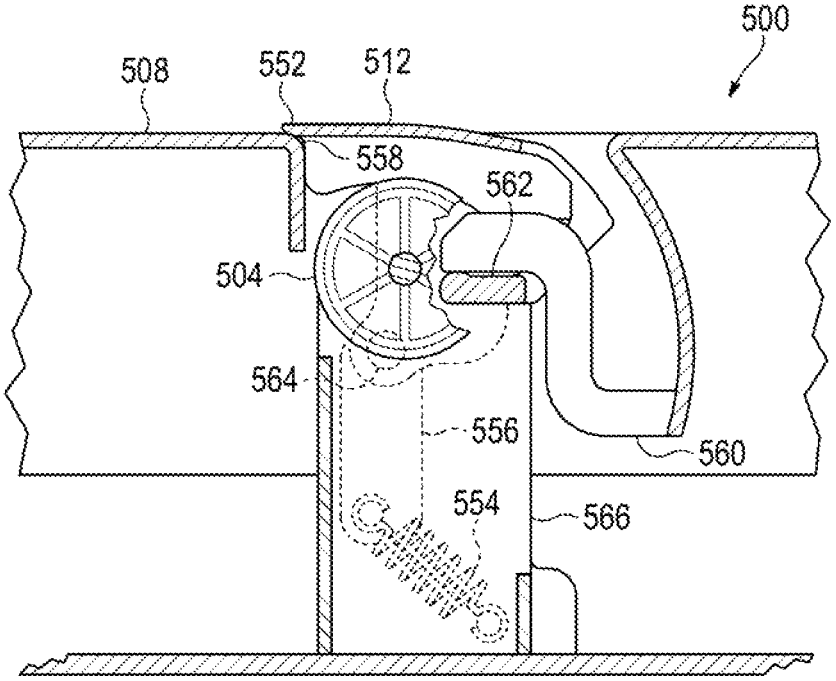

FIGS. 10-13 are sectional views depicting examples states of example platen devices 500 and 600. Referring to FIGS. 10 and 11, the platen device 500 generally includes a platen 508, a roller 504, and a cover 512. The platen 508 and the cover 512 may be interfaced to move conjunction with each other. For example, a first interface structure coupled to the platen 508 and a second interface structure coupled to the cover 512 are interfaced and guided by the interface guides such the cover 512 rotates into a covering position when the moveable platen 508 moves towards the dryer. The moveable platen 508 of FIGS. 10 and 11 includes a protrusion (e.g., leg 560) including a first guide surface that interfaces with the cover 512. Respectively, the cover 512 includes a protrusion (e.g., leg 562) and a second guide surface that interfaces with the platen 508. For example, the first guide surface guides the second guide surface as the protrusion of the platen 508 moves relative to the roller 504 to rotate the cover 512 around the roller 504. The roller 504 may be located on a fixed support 566 that does not move and/or moves independent to movement of the platen 508.

A bias member 554, such as a spring, is coupled to an arm support 556 to bias the cover 512 to rotate around pivot 564 to cover the roller 504. The bias member 554 may be coupled to the cover 512 such that the cover 512 is sustained over the aperture of the moveable platen 508 when the moveable platen 508 is above the axis of the roller 504. For example, the platen 508 of FIG. 10 is positioned to force the cover against the bias of the bias member 556 via the interface of leg 560 coupled to the platen and leg 562 coupled to the cover 512. When the platen 508 moves upwards away from the roller 504 the bias member 554 rotates arm 556 and the leg 560 of the platen allows the leg 562 to rotate into a covering position over the roller 504 and over the aperture of the platen 508. The cover 512 may include an overhang 552 that overlaps a lip 558 of the platen surface defining the aperture when the cover 512 is moved into a covering position. FIG. 10 shows the platen device 500 in an example non-loading state and FIG. 11 shows the platen device 500 in a loading state.

Figure 12:
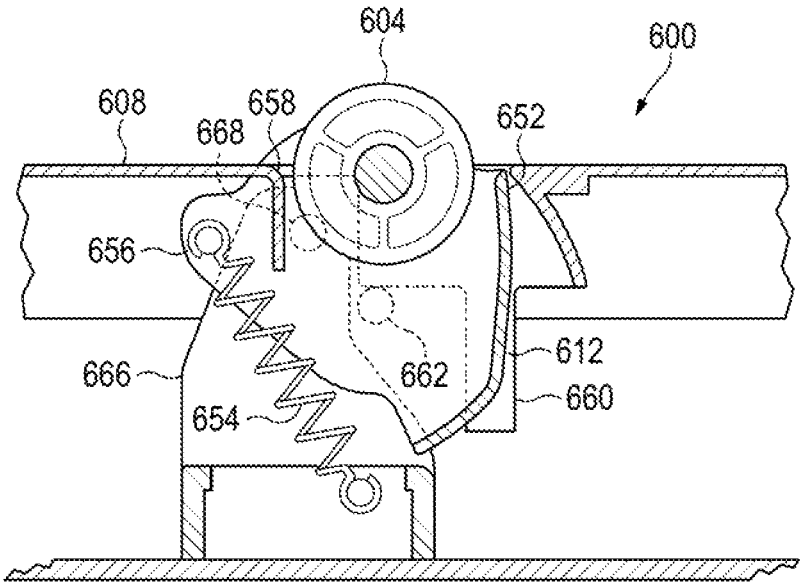
Figure 13:
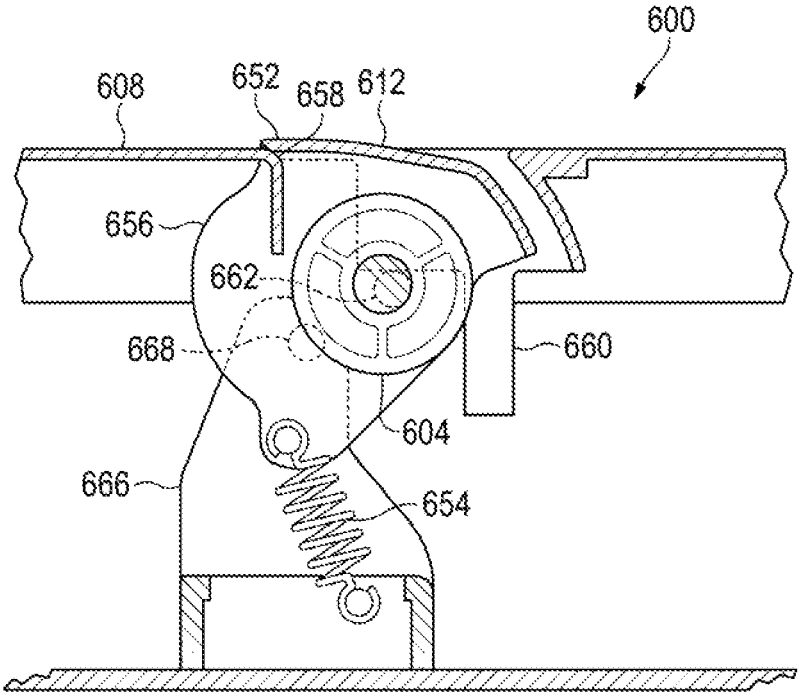

Referring to FIGS. 12 and 13, the platen device 600 generally includes a platen 608, a roller 604, and a cover 612. In general, the cover 612 rotates position around pivot 668 in conjunction with a height of the platen 608. The cover 612 is coupled to a support structure 656 attached to a bias member 654. The bias member 654 loads a force on the support structure to place the cover 612 into a covering position as shown in FIG. 13 where an overhang 652 of the cover 612 contacts the lip 658 of the platen 608. The bias member 654 is attached to a fixed support 666 (e.g., is anchored to the fixed support). The position of the roller 604 may be independent of the position of the platen 608 or may move inversely with respect to the height of the platen 608 such that the roller 604 moves out of position to contact media in a drying zone and the cover 612 moves into position to contact media in the drying zone. A leg 660 coupled to the platen 608 pushes on a pin 662 to provide force against the force provided by the bias member 654 to allow the support structure 656 to rotate around pivot 668. FIG. 12 shows the platen device 600 in an example non-loading state and FIG. 13 shows the platen device 600 in a loading state. In other examples, the cover 612 may be independently operated. For example, a plurality of covers 612 may be moved to cover the apertures of the platen and/or the rollers without movement of the platen occurring. For another example, a motor coupled to the cover 612 may rotate the cover 612 at an angle in conjunction with a motor that causes height adjustment of the moveable platen 608.

In other examples, a plurality of covers may move in conjunction with each other. For example, a moveable platen may include a first interface structure that mates with a second interface structure of each of the plurality of covers such that, as the moveable platen moves to a raised position, the plurality of covers cover apertures of the moveable platen corresponding to a plurality of passive rollers. As examples, by providing rollers in the drying zone, drying marks may be minimized and by providing covers for a moveable platen, media may be loaded through the drying zone without becoming damaged.

All of the features disclosed in this specification (including any accompanying claims, abstract and drawings), and/or all of the elements of any method or process so disclosed, may be combined in any combination, except combinations where at least some of such features and/or elements are mutually exclusive.

The terms "include," "have," and variations thereof, as used herein, mean the same as the term "comprise" or appropriate variation thereof. Furthermore the term "based on," as used herein, means "based at least in part on." Thus, a feature that is described as based on some stimulus may be based only on the stimulus or a combination of stimuli including the stimulus. Furthermore, the use of the words "first," "second," or related terms in the claims are not used to limit the claim elements to an order or location, but are merely used to distinguish separate claim elements.

The present description has been shown and described with reference to the foregoing examples. It is understood, however, that other forms, details, and examples may be made without departing from the spirit and scope of the following claims.

What is claimed is:

1. A dryer system comprising:

a dryer to dry web media in a drying zone between a printing zone and a media output holder;

a plurality of passive rollers in a media path of the drying zone, the plurality of passive rollers spaced apart in the media advance direction a distance corresponding to a deformation threshold based on expected pressure from the dryer on the web media; and a tension system to maintain an amount of tension on the web media in the drying zone based on dryer pressure, a distance between rollers, and a characteristic of the roll of web media.

2. The dryer system of claim 1, wherein:

the passive rollers are organized into rows oriented along a width of the media path with the passive rollers of each row aligned along rotation axis of the passive rollers and the rows are spaced apart a distance based on a deflection expected from pressure from the dryer.

3. The dryer system of claim 2, wherein:

the passive rollers include a plurality of formations on an outer surface of the passive roller; and the rows of passive rollers are spaced apart at distances that vary based on differing amounts of pressure expelled across the length of the dryer with respect to the media advance direction.

4. The dryer system of claim 2, comprising:

a moveable platen located below the dryer, the moveable platen to move relative to plurality of passive rollers and the dryer.

5. The dryer system of claim 4, wherein:

the moveable platen is placed in a raised position towards the dryer above an outer surface of the passive rollers when the dryer system is in a loading state to receive the web media into the drying zone; and the moveable platen is placed in a recessed position away from the dryer below the outer surface of the passive rollers when the dryer system is in a non-loading state to pass media through the drying zone.

6. The dryer system of claim 5, comprising:

a pushing device to move the web media onto to the moveable platen and into the drying zone.

7. The dryer system of claim 6, wherein the pushing device comprises:

a driven roller coupled to an arm; and a motor coupled to the arm and the driven roller to generate rotation of the roller and the arm concurrently such that the arm rotates to place the driven roller in a position to contact the web media concurrent to the driven roller providing force on the web media in the media advance direction.

8. The dryer system of claim 5, comprising:

a plurality of covers to cover apertures of the moveable platen corresponding to the plurality of passive rollers.

9. The dryer system of claim 8, further comprising:

a fixed support with interface guides;

the moveable platen includes a first interface structure;

the plurality of covers includes a second interface structure; and the first interface structure and the second interface structure are interfaced and guided by the interface guides such that the plurality of covers rotate into a covering position when the moveable platen moves towards the dryer.

10. A dryer system comprising:

a dryer to dry web media in a drying zone between a printing zone and a media output holder;

a plurality of passive rollers in a media path of the drying zone; and a tension system to maintain an amount of tension on the web media in the drying zone based on dryer pressure to prevent deformation of the media on the rollers beyond a deformation threshold.

11. The dryer system of claim 10, wherein the tension system is to maintain the amount of tension based also on a characteristic of the web media.

12. The dryer system of claim 11, wherein the characteristic of the web media is flexibility of the web media.

13. The dryer system of claim 10, wherein the tension system is to maintain the amount of tension based also on a spacing between the rollers.

14. The dryer system of claim 10, wherein the rollers are arranged in rows, the rows being spaced together more closely at a center of the drying zone and further apart at ends of the drying zone with respect to a media advance direction.

* * * * *